US009474362B2

(12) United States Patent
Woracek

(10) Patent No.: US 9,474,362 B2
(45) Date of Patent: Oct. 25, 2016

(54) EXTENDING FOLDING TABLE FOR FURNITURE

(71) Applicant: Pöttker Auszugsysteme GmbH, Lippstadt (DE)

(72) Inventor: Karsten Woracek, Erwitte (DE)

(73) Assignee: Pöttker Auszugsysteme GmbH, Lippstadt (DE)

( * ) Notice: Subject to any disclaimer, the term of this patent is extended or adjusted under 35 U.S.C. 154(b) by 0 days.

(21) Appl. No.: 14/881,298

(22) Filed: Oct. 13, 2015

(65) Prior Publication Data

US 2016/0100683 A1 Apr. 14, 2016

(30) Foreign Application Priority Data

Oct. 14, 2014 (DE) ..... 20 2014 104 875 U

(51) Int. Cl.
*A47B 1/04* (2006.01)
*A47B 1/05* (2006.01)
*A47B 83/04* (2006.01)

(52) U.S. Cl.
CPC ..... *A47B 1/05* (2013.01); *A47B 83/045* (2013.01); *A47B 1/04* (2013.01)

(58) Field of Classification Search
CPC ..... A47B 83/045; A47B 1/05; A47B 1/04; A47B 96/02; A47B 96/025
See application file for complete search history.

(56) References Cited

U.S. PATENT DOCUMENTS 1,325,454 A * 12/1919 Stone ..... A47B 1/05 108/72
1,334,415 A * 3/1920 Stone ..... A47B 1/05 108/74
1,346,276 A * 7/1920 Stone ..... A47B 1/05 108/69
1,689,663 A * 10/1928 Cooper ..... A47B 1/05 108/70
2,112,087 A * 3/1938 Golod ..... A47B 83/045 126/500
2,412,849 A * 12/1946 Weber ..... A47B 83/045 108/93
2,556,612 A * 6/1951 Buntin ..... A47B 83/045 312/316
2,577,724 A * 12/1951 Weller ..... A47B 1/05 108/72
4,263,854 A * 4/1981 Moore ..... A47B 83/045 108/37
4,715,295 A * 12/1987 Hartman ..... A47B 23/046 108/87
7,963,231 B2 * 6/2011 Osborne ..... A47B 5/006 108/40
8,100,062 B1 * 1/2012 Anghel ..... A47B 1/05 108/69
9,010,885 B2 * 4/2015 Kahle ..... A47B 83/045 108/40

FOREIGN PATENT DOCUMENTS

DE 8331779.1 U1 2/1984
EP 1444922 A2 11/2004

* cited by examiner

*Primary Examiner* — Hanh V Tran
(74) *Attorney, Agent, or Firm* — Richard M. Goldberg

(57) ABSTRACT

An extending folding table for furniture, includes a base plate (34) guided on a furniture body (10) so as to be extensible therefrom, and a supplement plate (36) articulated to the base plate and adapted to be folded back onto the base plate, the base plate (34) being adapted to be locked at the furniture body (10) in the extended position by a lock (40), wherein the lock is adapted to be actuated by a trigger pin (50) which projects from a top side of the base plate (34) and on which the supplement plate (36) rests in the folded position.

6 Claims, 3 Drawing Sheets

EXTENDING FOLDING TABLE FOR FURNITURE

BACKGROUND OF THE INVENTION

The invention relates to an extending folding table for furniture, comprising a base plate guided on a furniture body so as to be extensible therefrom, and a supplement plate articulated to the base plate and adapted to be folded back onto the base plate.

Extending folding tables of this type are known in the art. The supplement plate is connected to the front edge of the base plate by a hinge. In the extended use position, both plates are arranged in a common plane, so that, together, they form a table plate disposed in a position in front of the furniture body and held on telescopic guides which are extensible from the body. When the table shall be stowed in the body, the supplement plate is folded 180° back onto the base plate so that it rests flat on the base plate. Both plates are then jointly pushed back into the interior of the body together with the telescopic guides.

SUMMARY OF THE INVENTION

It is an object of the invention to provide for a safe fixation of the extending folding table in the extended position.

In order to achieve this object, according to the invention, the base plate is adapted to be locked at the furniture body in the extended position by a lock, wherein the lock is adapted to be actuated by a trigger pin which projects from a top side of the base plate and on which the supplement plate rests in the folded position.

In the extended use position of the extending folding table, the base plate and therewith the entire unit formed by the base plate, the supplement plate and the telescopic guides is locked at the furniture body so that the table will not retreat into the interior of the body when it is subject to a force acting in push-in direction. When the table is to be stowed in the body, and the supplement plate is folded back onto the base plate for that purpose, the supplement plate presses onto the projecting end of the trigger pin and thereby actuates the lock so as to unlock the same so that the plates may then be pushed back into the interior of the body.

Useful details and further developments of the invention are indicated in the dependent claims.

BRIEF DESCRIPTION OF THE DRAWINGS

An embodiment example will now be described in conjunction with the drawings, wherein.

DETAILED DESCRIPTION

Figure 1:
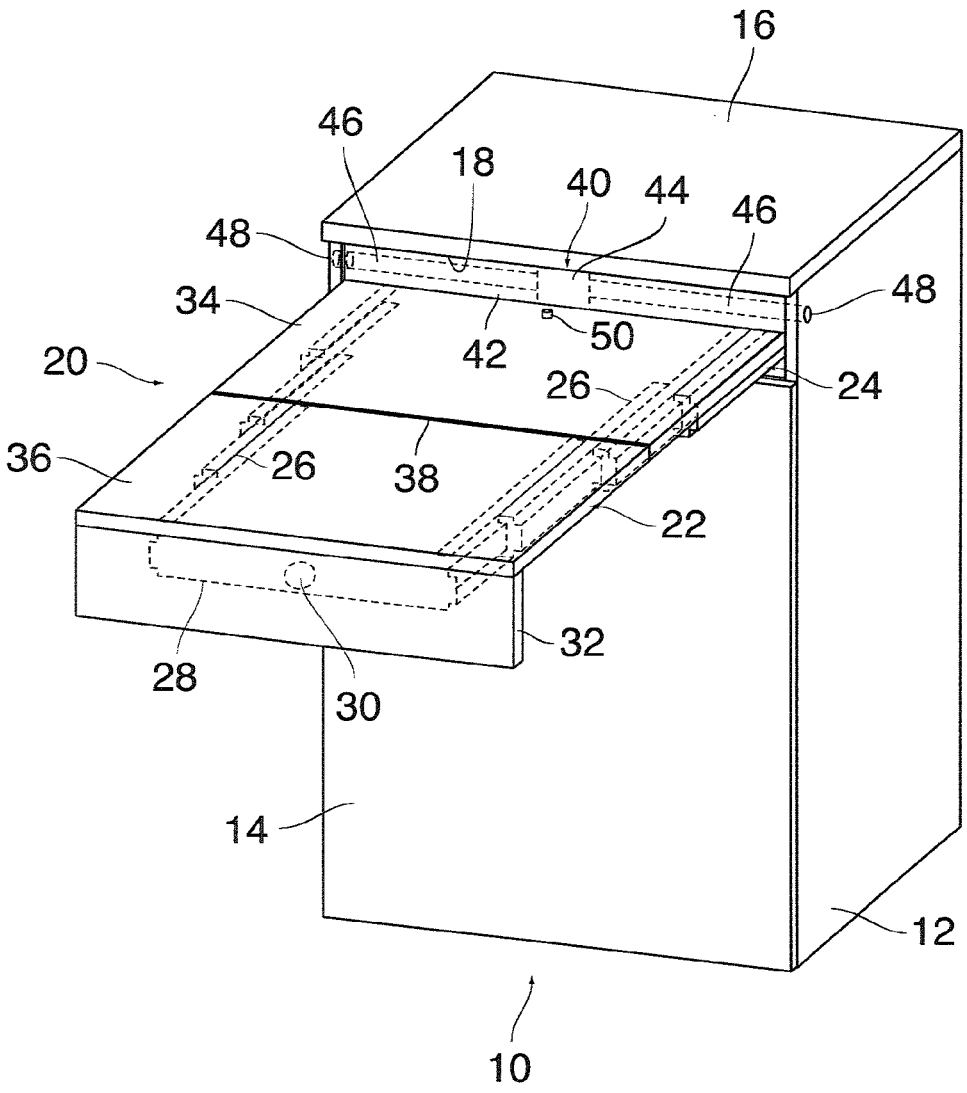
FIG. 1 is schematic perspective view of a cabinet having a body and an extending folding table according to the invention in extended and unfolded position.

The cabinet shown in FIG. 1 has a body 10 which is formed in a known manner by side walls 12, a front wall 14, a top 16 and a rear wall which has not been shown. The front wall 14 reaches only to a position slightly below the lower edge of the top 16, so that an opening 18 is formed through which an extending folding table 20 can be drawn out of the body 10.

The extending folding table 20 has a two-part table plate 22 which is supported on a carrier 24 that is adapted to be drawn out from the body 10. In the example shown, the carrier 24 is formed by a four-stage telescopic guide mechanism comprising two-four stage telescopic guide rail assemblies 26 having free ends rigidly connected by a cross-bar 28. In the center of the cross-bar 28, there is provided a rotary bearing 30 defining an axis of rotation that runs in the extension direction, a rectangular front panel 32 being rotatably supported at the bearing. The front panel 32 is arranged parallel to the front plate 14 of the body. The rotary bearing 30 is disposed at the back side of the front panel 32 such that it is offset in vertical direction from the center of the rectangular front panel 32, upwardly in the condition shown in FIG. 2.

The table plate 20 is formed by a base plate 34 which is an inner plate in relation to the extension direction, and an outer supplement plate 36 connected to the base plate by a hinge 38. In the extended condition shown in FIG. 1, both plates 34, 36 are arranged in a common plane and are both supported on the telescopic guide rail assemblies 26.

When the extending folding table 20 is to be stowed in the body 10, the supplement plate 36 is folded back onto the base plate 34 at the hinge 38, and both plates are pushed back into the body 10 in a condition in which they are superposed one upon the other. The base plate 34 is mounted for example on the second stage of the telescopic guide mechanism, so that, when the carrier 24 is extended completely and reaches the position shown in FIG. 1, the base plate 34 is withdrawn only to the extent shown in FIG. 1. Then, the projecting part of the carrier 24 forms a support for the supplement plate 36 when this supplement plate is unfolded into its use position.

Figure 2:
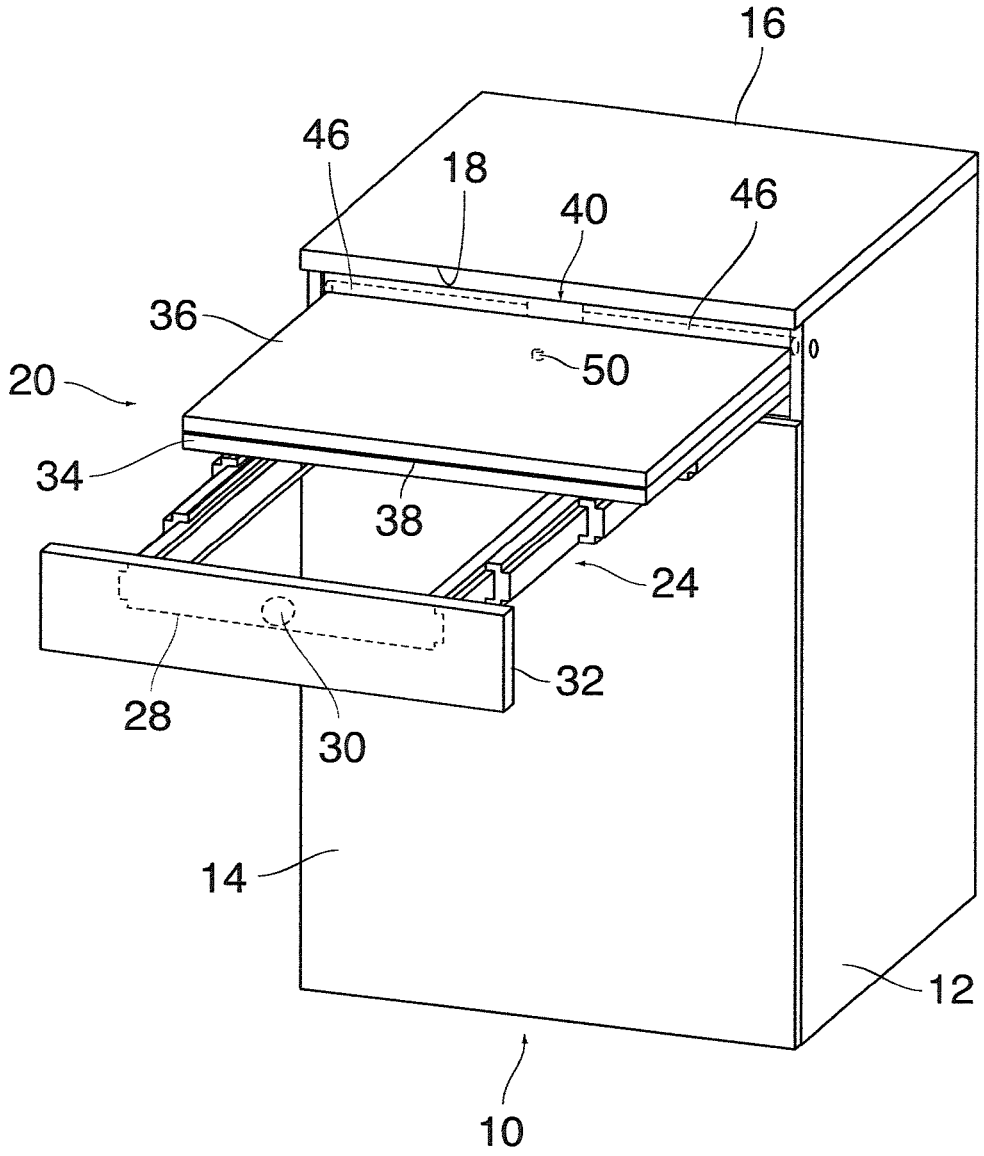
FIG. 2 the cabinet shown in FIG. 1 in an intermediate state in a process of stowing the extending folding cable in the body.

FIG. 2 shows the cabinet in a condition in which the supplement plate 36 has been folded back onto the base plate 34, but the carrier 24 is still in the completely extended position. Now, the front panel 32 can be rotated 180° about the rotary bearing 30 so as to be brought into a position in which it fills the opening 18 when the extending folding table 20 is pushed back into the body.

In order to prevent that the extending folding table 20, when in the extended position shown in FIG. 1, is inadvertently pushed back into the body, a lock 40 is provided at the rear edge of the base plate 34, the lock being obscured in FIGS. 1 and 2 by a blind 42 uprising from the base plate 34, the lock having therefore been shown only in phantom lines in these figures.

The lock 40 comprises a transmission 44 arranged centrally behind the blind 42, with two locking rods 46 extending horizontally to opposite sides from the transmission so as to engage in holes 48 in the side walls 12 of the body when the lock is in the locked state. The transmission 44 has a trigger pin 50 which, in the condition shown in FIG. 1, projects upwardly through a hole in the base plate 34 and projects slightly beyond the top surface of the base plate 34 with its free end.

When the supplement plate 36 is folded into the position shown in FIG. 2, it presses onto the free end of the trigger pin 50 and pushes the trigger pin downward, whereby the lock 40 is actuated and the locked state is cancelled.

The construction and function of the lock 40 will now be explained with reference to FIGS. 3 to 6.

Figure 3:
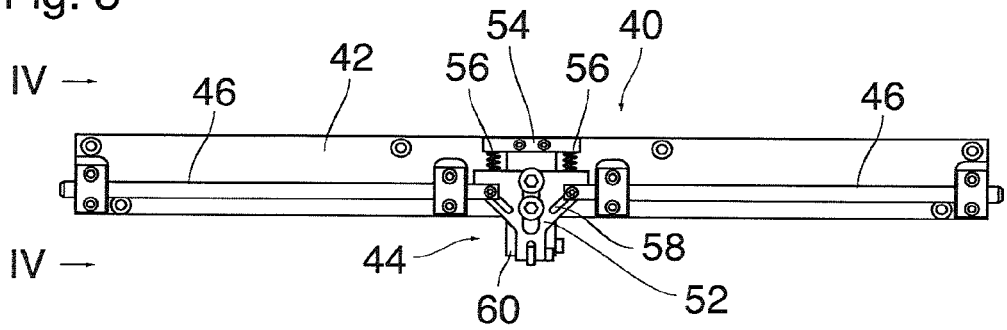
FIG. 3 a back-side view of a lock in a locked condition.

FIG. 3 is a view of the back side of the lock 40 fixed at the back side of the blind 42. The transmission 44 comprises a slide 52 held on a holder 54 so as to be slideable in vertical direction and being elastically biased downwards by springs 56. Two elongated holes 58 are formed in the slide 52 in a V-configuration, and a pin provided at one end at one of each of the locking rods 46 is engaged in each of the elongated holes.

The locking rods 46 are slidably guided at the blind 42. In the position shown in FIG. 3, the slide 52 is in a lowered position and the locking rods 46 are held in a position in which their ends project beyond the blind 42 and engage in the holes 48 in the side walls of the body. In this way, the base plate 34 and therewith also the supplement plate 36 and the telescopic guide rail assemblies 26 are locked in the position shown in FIG. 1.

Figure 4:
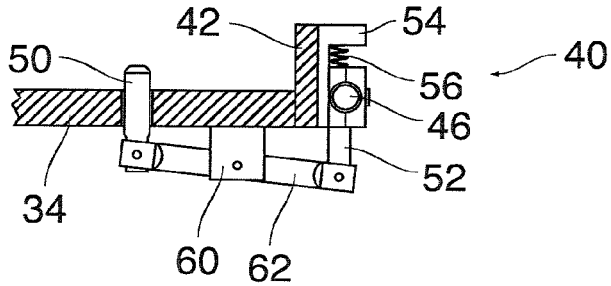
FIG. 4 a side view of the lock as seen in the direction of arrows IV-IV in FIG. 3.
Figure 5:
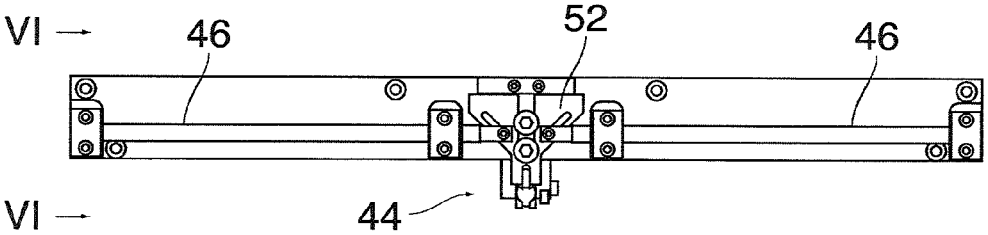
FIG. 5 a back-side view of the lock in the unlocked state.

As has been shown in FIG. 4, a bracket 60 is arranged at the bottom side of the base plate 34, and a rocker 62 is pivotally supported in the bracket. One end of the rocker 62 is articulated to the lower end of the slide 52, and the opposite end is articulated to the lower end of the trigger pin 50. Since the slide 52 is in the lowered position in FIG. 4, the trigger pin 50 is held in a lifted position in which it projects upwardly from the base plate 34.

Figure 6:
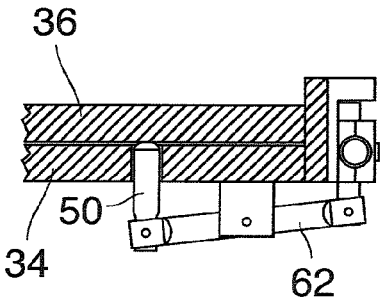
FIG. 6 a view in the direction of arrows VI-VI in FIG. 5.

When now, the supplement plate 36 is folded back onto the base plate 34, the supplement plate 36 presses onto the top end of the trigger pin 50, as shown in FIG. 6, and presses the trigger pin downwards. As a result, the rocker 62 is pivoted such that it presses the slide 52 upwards against the force of the springs 56. Due to the upward movement of the slide 52, the slanting elongated holes 58 draw the inner ends of the locking rods 46 together, as has been shown in FIG. 5. As a result, the free ends of the locking rods are withdrawn from the holes 48, so that the locked state is cancelled and the entire extending folding table can be stowed in the interior of the body 10.

When the table has been extended again and the supplement plate 36 has been folded again into the position shown in FIG. 1, the trigger pin 50 is released from the weight of the supplement plate, and the springs 56 ensure an automatic re-establishment of the locked state.

What is claimed is:

1. An extending folding table for furniture having a furniture body, the extending folding table comprising:

a base plate guided on the furniture body so as to be extensible therefrom, a supplement plate articulated to the base plate and adapted to be folded back onto the base plate, a lock for locking the base plate at the furniture body in an extended position, and a trigger pin for actuating the lock, the trigger pin adapted to project from a top side of the base plate and on which the supplement plate rests in the folded position.

2. The table according to claim 1, wherein the lock has at least one locking rod slidable in a horizontal direction along a rear edge of the base plate, the at least one locking rod adapted to engage in at least one hole in a side wall of the furniture body.

3. The table according to claim 2, wherein the lock has a transmission arranged to translate a vertical movement of the trigger pin into a horizontal sliding movement of said at least one locking rod.

4. The table according to claim 3, wherein said at least one locking rod is elastically biased into a locked position and adapted to be withdrawn by depressing the trigger pin.

5. The table according to claim 3, wherein the transmission has a slide which is movable in a vertical direction and has, for each of said at least one locking rod, an inclined elongated hole, a pin formed at an end of each locking rod being engaged in a respective said elongated hole.

6. The table according to claim 3, wherein the transmission has a rocker pivotable about an axis that extends below the base plate, and wherein one end of the rocker is articulated to the trigger pin.

* * * * *